United States Patent [19]

Wong et al.

[11] Patent Number: 5,003,230

[45] Date of Patent: Mar. 26, 1991

[54] FLUORESCENT LAMP CONTROLLERS WITH DIMMING CONTROL

[75] Inventors: John M. Wong, Buffalo Grove; Michael A. Kurczak, Roselle, both of Ill.

[73] Assignee: North American Philips Corporation, New York, N.Y.

[21] Appl. No.: 358,257

[22] Filed: May 26, 1989

[51] Int. Cl.[5] ..... H05B 41/00

[52] U.S. Cl. ..... 315/279; 315/307; 315/DIG. 4

[58] Field of Search ..... 315/246, 276, 279, 291, 315/306, 307, DIG. 4, DIG. 7

[56] References Cited

U.S. PATENT DOCUMENTS

| | | | |
|---|---|---|---|
| 3,611,021 | 10/1971 | Wallace | 315/DIG. 5 X |
| 4,251,752 | 2/1981 | Stolz | 315/DIG. 4 X |
| 4,453,109 | 6/1984 | Stupp et al. | 315/219 |
| 4,498,031 | 2/1985 | Stupp et al. | 315/307 |
| 4,585,974 | 4/1986 | Stupp et al. | 315/DIG. 5 X |
| 4,698,554 | 10/1987 | Stupp et al. | 315/205 X |
| 4,700,113 | 10/1987 | Stupp et al. | 315/DIG. 7 X |
| 4,717,863 | 1/1988 | Zeiler | 315/244 X |

*Primary Examiner*—Robert J. Pascal

*Attorney, Agent, or Firm*—Neuman, Williams, Anderson & Olson

[57] ABSTRACT

A fluorescent lamp controller uses a dimmer circuit having an isolation transformer. The controller applies a high frequency current to the primary winding of the transformer. The secondary winding is coupled to a control input via loading circuitry. A detector circuit supplies a signal to the lamp controller indicative of the resultant loading of the transformer to control lamp intensity.

20 Claims, 7 Drawing Sheets

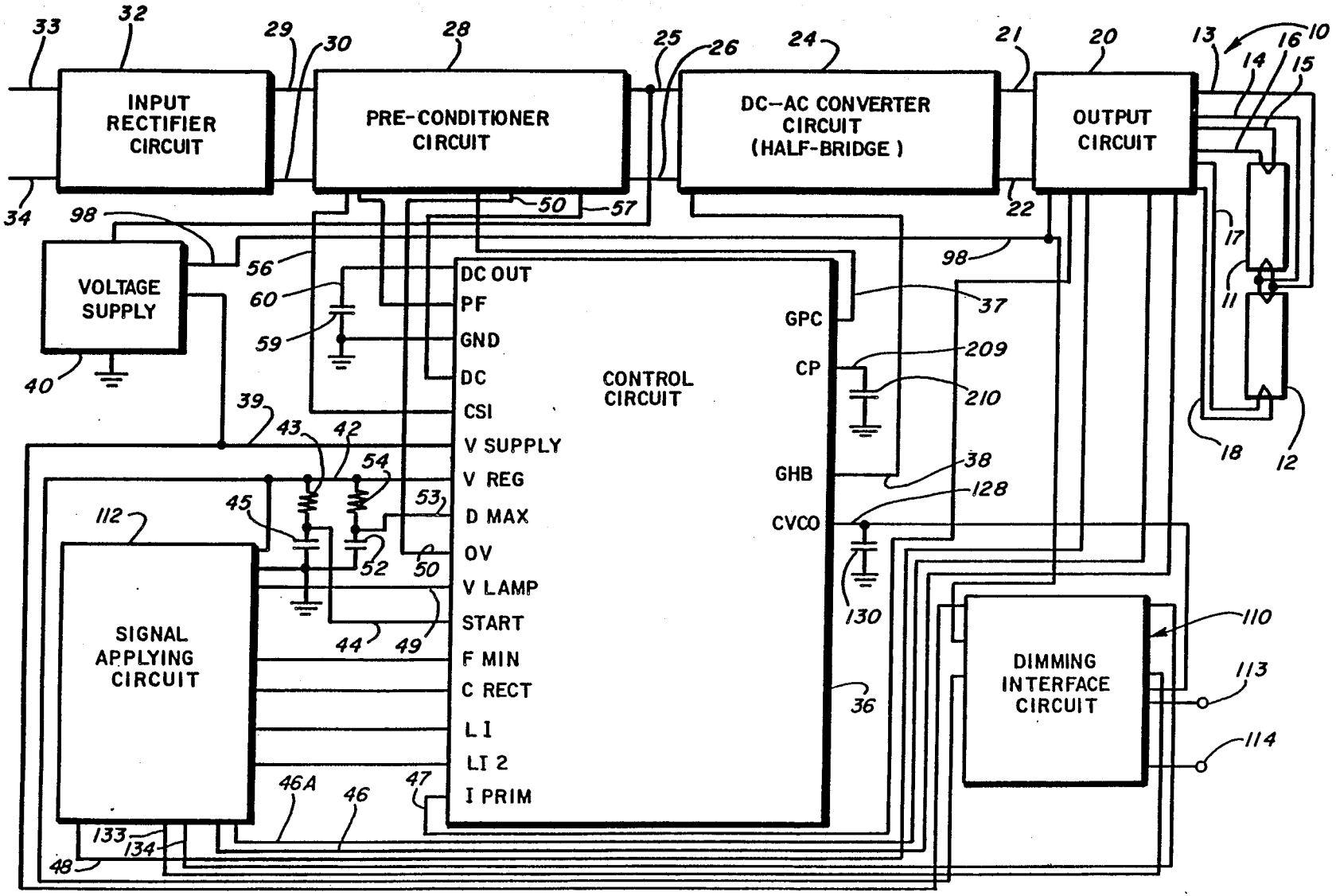
OUTPUT CIRCUIT
DC-AC CONVERTER CIRCUIT (HALF-BRIDGE)
PRE-CONDITIONER CIRCUIT
INPUT RECTIFIER CIRCUIT
VOLTAGE SUPPLY
CONTROL CIRCUIT
SIGNAL APPLYING CIRCUIT
DIMMING INTERFACE CIRCUIT
GPC
CP
GHB
CVCO
DC OUT
PF
GND
DC
CSI
V SUPPLY
V REG
D MAX
OV
V LAMP
START
F MIN
C RECT
L1
LI 2
I PRIM

FLUORESCENT LAMP CONTROLLERS WITH DIMMING CONTROL

BACKGROUND OF THE INVENTION

1. Field of the Invention

This invention relates to fluorescent lamp controllers and dimming controls for use therewith and more particularly to the provision of a dimming control which provides protective isolation between input terminals and lamp energizing circuitry and which facilitates accurate and safe control of light intensity over a wide range. The invention provides dimming controls which are efficient and highly reliable and are readily and economically manufacturable.

2. Background of the Prior Art

Prior art references relating to fluorescent lamp controllers are reviewed in the introductory portion of the specification of an application of Mark W. Fellows, et al., U.S. Ser. No. 219,923, filed July 15, 1988, now U.S. Pat. No. 4,952,849, the disclosure of which is incorporated by reference. Such prior art references include the Wallace U.S. Pat. No. 3,611,021, the Stolz U.S. Pat. No. 4,251,752, the Stupp et al. U.S. Pat. Nos. 4,453,109, 4,498,031, 4,585,974, 4,698,554 and 4,700,113, and the Zeiler U.S. Pat. No. 4,717,863, relating to various forms of SMPS (Switch Mode Power Supply) circuits operative at high frequencies to obtain higher efficiency and other advantages in the energization of fluorescent lamps. The prior art also includes disclosures of circuits for control of the energization of fluorescent lamps to control intensity and effect dimming of the lamps when desired.

SUMMARY OF THE INVENTION

This invention was evolved with the general object of providing a dimmer control for use with fluorescent lamp controllers and which is operative to control light intensity over a wide range while having isolation and other protective features and while being readily and economically manufacturable. It is also an object of the invention to provide a dimmer control having features such as to obtain high efficiency and very safe and reliable operation.

In the development of the invention, consideration has been given to the use of various possible dimming circuit arrangements and important aspects of the invention relate to the recognition of potential problems with such arrangements as well as in the recognition of features which are usable to advantage. A further specific object of the invention is to provide a dimmer control which is usable with and readily connectable to controllers such as disclosed in the aforementioned Fellows et al. application and which retain all of the advantageous features thereof so as to be fully compatible therewith.

The Fellows et al. system has many advantageous features including features which allow for control of intensity and which can be used for dimming, although no specific disclosure is contained in the application. In the Fellows et al. system, an output circuit which operates as a tuned circuit couples the output of a variable frequency DC-AC converter circuit to a fluorescent lamp load. A control circuit operates upon energization of the controller to operate the DC-AC converter at a certain high frequency which is well above a no-load resonant frequency of the output circuit and above a frequency that at which the output voltage would be sufficent for ignition. Then the control circuit operates in a ignition phase in which it gradually reduces the frequency until ignition occurs. Thereafter, the control circuit operates in an operating phase in which it automatically controls lamp current through control of the frequency of operation of the DC-AC converter.

Another feature of the Fellows et al. controller relates to the connection of the resonant capacitor in parallel relation to the fluorescent lamp load and a transformer winding in a manner such as to limit the voltage across the winding in accordance with lamp voltage. The parallel arrangement also facilitates the use of a single resonant capacitor for both the ignition and operating phases.

With these and other features of the system as disclosed in the Fellows et al. application, stable operation in a range well above the resonant frequency is facilitated, which has a very important advantage in insuring that transistors of the DC-AC converter are protected against a capacitive load condition, i.e., one in which the current leads the voltage and in which destruction of the transistors might result. A further feature relates to the provision of additional protection through the use of circuitry which automatically switches to a safe condition when the phase of current relative to voltage is less than a certain safe value, preferably by sweeping the DC-AC converter to a high frequency. Additional features relate to a pre-conditioner circuit which is supplied with a full-wave rectified 50 or 60 Hz voltage and which includes SMPS circuitry operating as an up-converter to supply a DC voltage to the DC-AC converter which is automatically maintained at a relatively high level for stable efficient operation. The automatic level control is obtained by controlling the width of gating pulses applied to the circuit in response to a signal which is proportional to the average value of the output voltage of the pre-conditioner circuit. Power factor control is also obtained.

Additional features of the system as disclosed in the Fellows et al. application relate to the details of the construction and operation of the control circuit which controls both the DC-AC converter and the pre-conditioner circuit. The control circuit is preferably implemented as a single integrated circuit component or "chip" arranged for use with external components in a manner such as to be usable with different types of fluorescent lamp or other loads of similar nature and to permit selection of external component values to obtain optimum performance with any particular type of fluorescent lamp or other load connected thereto. It achieves a highly desirable synchronized control of cascaded pre-conditioner and DC-AC converter circuits, and provides reliable start-up operations and a number of safety and protection features which insure a high degree of reliability and protect against destructive failures which might otherwise result from use of defective lamps or the absence of lamps or from any one of many possible problems.

In a dimmer circuit which is constructed in accordance with the invention, a transformer is used to provide a protective DC isolation between a control input, which may be accessible to a user and which may operate at low voltage levels, and controller circuits operative at relatively high voltages. A high frequency current is applied to a primary winding of the transformer while control voltage input terminals are connected to a secondary winding of the tranformer, the resultant loading of the transformer being detected to control lamp intensity. Important features relate to circuitry coupling the input terminals to the secondary winding and to circuitry for detecting the loading of the transformer and applying controls to a fluorescent lamp controller to facilitate safe, accurate and reliable control of lamp intensity.

In accordance with a specific feature of the invention, a detector circuit is provided for developing a DC voltage corresponding to loading of the transformer and the dimmer circuit includes circuitry which is controlled from the DC voltage developed by the detector circuit and which is operative to provide a controlled resistive impedance between a pair of output terminals which are connectable to a control circuit of the controller to control its operation. In a preferred arrangement, a comparator responds to a triangular voltage which is developed by a control circuit of the controller to develop a pulse-width modulated signal which controls an analog switch.

Another important feature relates to the provision of a detector circuit in the form of a peak detector which is preferably connected directly to the primary winding, no additional winding being required for detection of the loading of the transformer.

Another specific feature relates to the provision of a level shift circuit which is coupled in series with the primary winding and which provides a bias signal necessary for optimum operation. A further specific feature relates to the provision of temperature compensation, preferably using a thermistor in the level shift circuit.

Additional important features relate to the construction of a clipping circuit which is connected between the secondary winding of the transformer and the input terminals of the dimmer circuit. A full-wave bridge rectifier is coupled to the secondary winding and its output is coupled to the input terminals, preferably using a transistor which is operative to conduct a current from the output of the bridge rectifier in response to an input control current of low magnitude. The clipping circuit further includes filter means for substantially obviating the transmission of noise to the input terminals.

Still another feature of the invention relates to the optional provision of an on/off circuit for obtaining a very low power "off" state when the control input voltage is below a certain level.

Further features relate to the use of signals which are available from the controller circuitry and to connections of the dimmer circuitry to the controller circuitry in a manner such as to obtain a construction which is highly efficient and fully compatible with controllers such as disclosed in the Fellows et al. application or other controllers of similar nature.

This invention contemplates other objects, features and advantages which will become more fully apparent from the following detailed description taken in conjunction with the accompanying drawings.

BRIEF DESCRIPTION OF THE DRAWINGS

FIG. 1 is a schematic diagram illustrating a dimming interface circuit of the invention and a invention fluorescent lamp controller connected to the interface circuit to be controlled therefrom;

DESCRIPTION OF PREFERRED EMBODIMENTS

Figure 3:
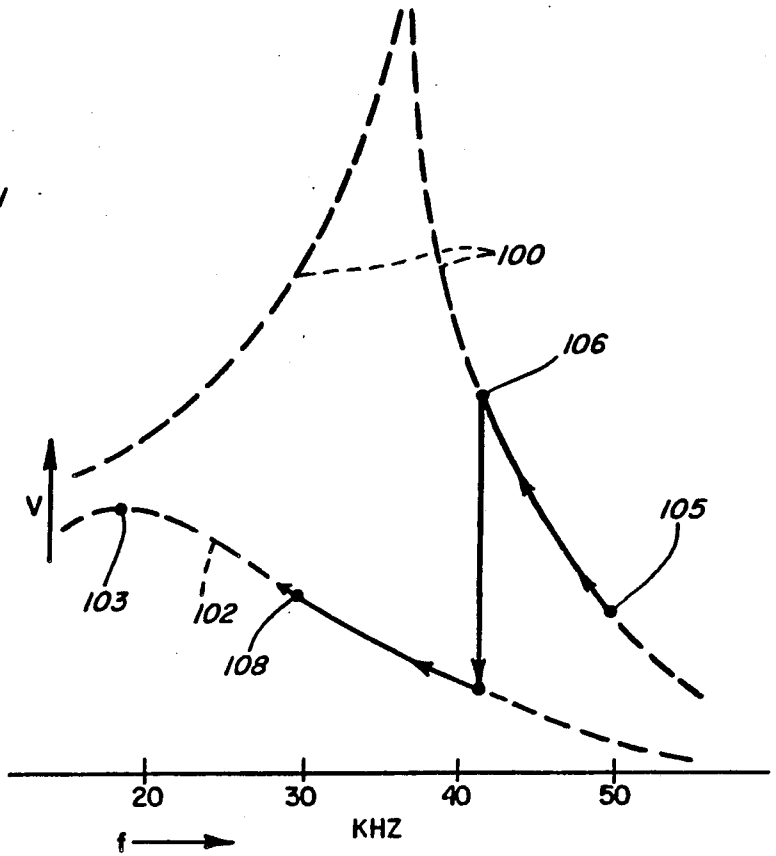
FIG. 3 is a graph illustrating characteristics of the output circuit of FIG. 2 and its mode of operation.

Reference numeral 110 generally designates a dimming interface circuit which is constructed in accordance with the principles of the invention. As shown in FIG. 1, interface circuit 110 may be connected to control signal-applying circuitry 112 and other circuitry of a fluorescent lamp controller which is generally designated by reference numeral 10. The controller 10 controls the energization of two fluorescent lamps 11 and 12 in accordance with a low voltage DC control signal applied to input terminals 113 and 114 of the interface circuit 110. The interface circuit 110 provides high voltage isolation between non-grounded circuits of the controller 10 and grounded dimming controls which are connected to the terminals 113 and 114. It converts a low voltage DC input control signal of a standardized form to a form which is compatible with the circuitry of the controller 10. The interface circuit 110 is energized from the controller 10 and it achieves safe and highly reliable control of energization of the lamps 11 and 12.

As previously indicated, the dimmer control of the invention is particularly designed for connection to controllers such as disclosed in the Fellows et al. application and which may be used for energization of fluorescent lamps, halogen lamps or other gaseous discharge devices or for energization of other types of loads. It will be understood that fluorescent lamp loads are referred to herein for ease of description and that reference herein and in the claims to fluorescent lamps and fluorescent lamp loads are to be construed as including all other types of loads capable of being energized by controllers to which the dimmer control of the invention may be connected.

The construction of the interface circuit 110 of the invention is shown in detail in the circuit diagram of FIG. 4, but since the circuit 110 is particularly designed for use with the illustrated controller 10, certain features of the controller 10 are described before describing the circuit 110 of FIG. 4 in detail, it being understood that the interface circuit 110 of the invention may be used with controllers which differ from the illustrated controller 10.

Circuits of Controller 10 (FIG. 1)

The illustrated controller 10 is constructed in accordance with the disclosure in the aforesaid application Fellows et al. application U.S. Ser. No. 219,923, the complete disclosure of which is incorporated by reference. As shown in FIG. 1, the fluorescent lamps 11 and 12 are connectable through wires 13–18 to an output circuit 20, wires 13 and 14 being connected to one filament electrode of lamp 11 and one filament electrode of lamp 12, wires 15 and 16 being connected to the other filament electrode of lamp 11 and wires 17 and 18 being connected to the other filament electrode of lamp 12. It will be understood that the invention is not limited to use with a controller which is usable with two lamps only.

The output circuit 20 is connected through lines 21 and 22 to the AC output of a DC-AC converter circuit 24 which is connected through lines 25 and 26 to the output of a pre-conditioner circuit 28, the circuit 28 being connected through lines 29 and 30 to the output of input rectifier circuit 32 which is connected through lines 33 and 34 to a source of a 50 or 60 Hz, 120 volt RMS voltage. In the operation of the illustrated controller 10, the pre-conditioner circuit 28 responds to a full-wave rectified 50 or 60 Hz voltage having a peak value of 170 volts, developed at the output of circuit 32, to supply to the DC-AC converter circuit 24 a DC voltage having an average magnitude of about 245 volts. The DC-AC converter circuit 24 converts the DC voltage from the pre-conditioner circuit 28 to a square wave AC voltage which is applied to the output circuit 20 and which has a frequency in a range of from about 25 to 50 KHz. It will be understood that values of voltages, currents, frequencies and other variables, and also the values and types of various components, are given by way of illustrative example to facilitate understanding of the invention, and are not to be construed as limitations.

Figure 6:
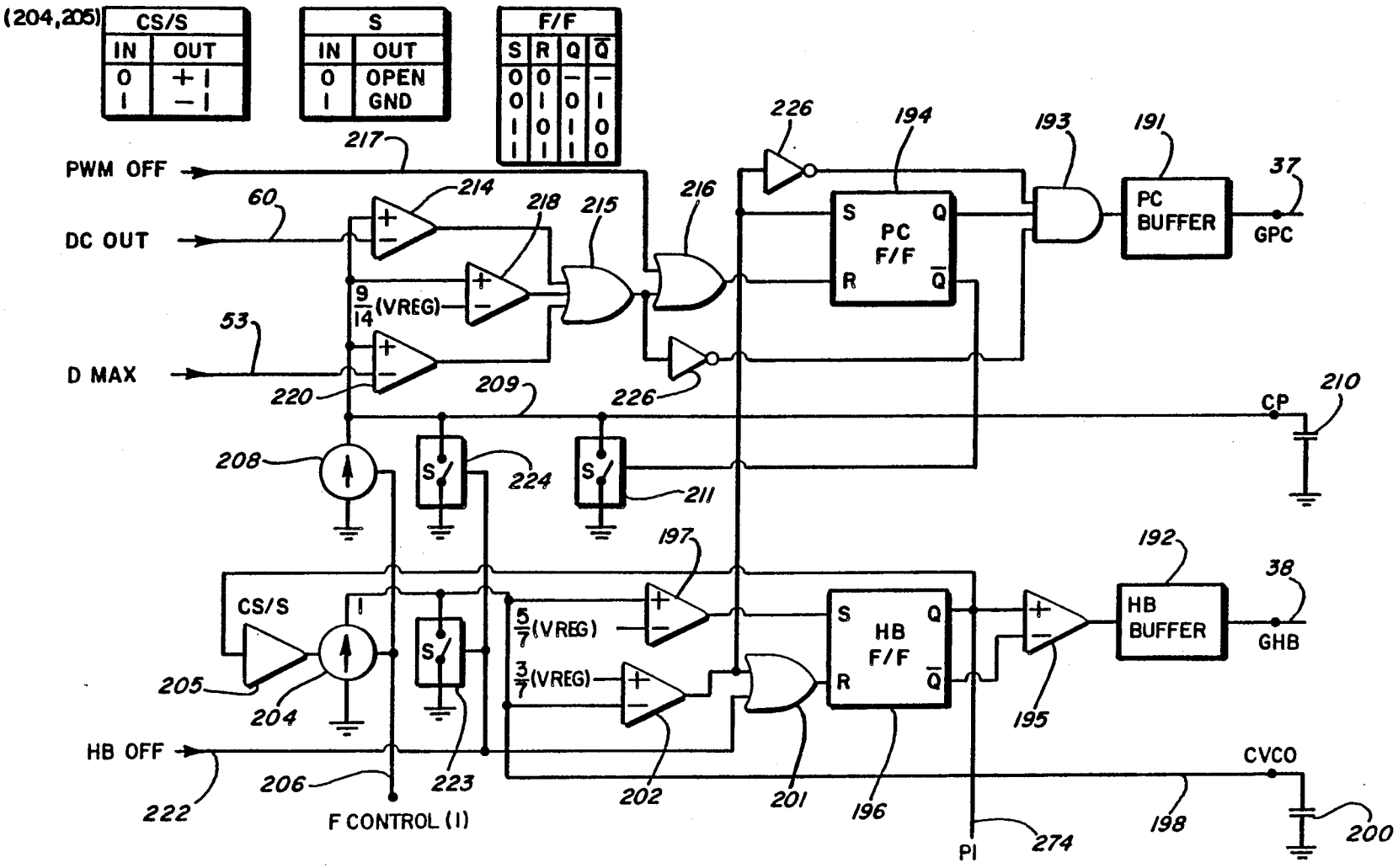
FIG. 6 is a schematic diagram of a portion of logic and analog circuitry incorporated in a control circuit of the controller of FIG. 1 and operative for generating high frequency square wave and pulse-width modulated gating signals.
Figure 7:
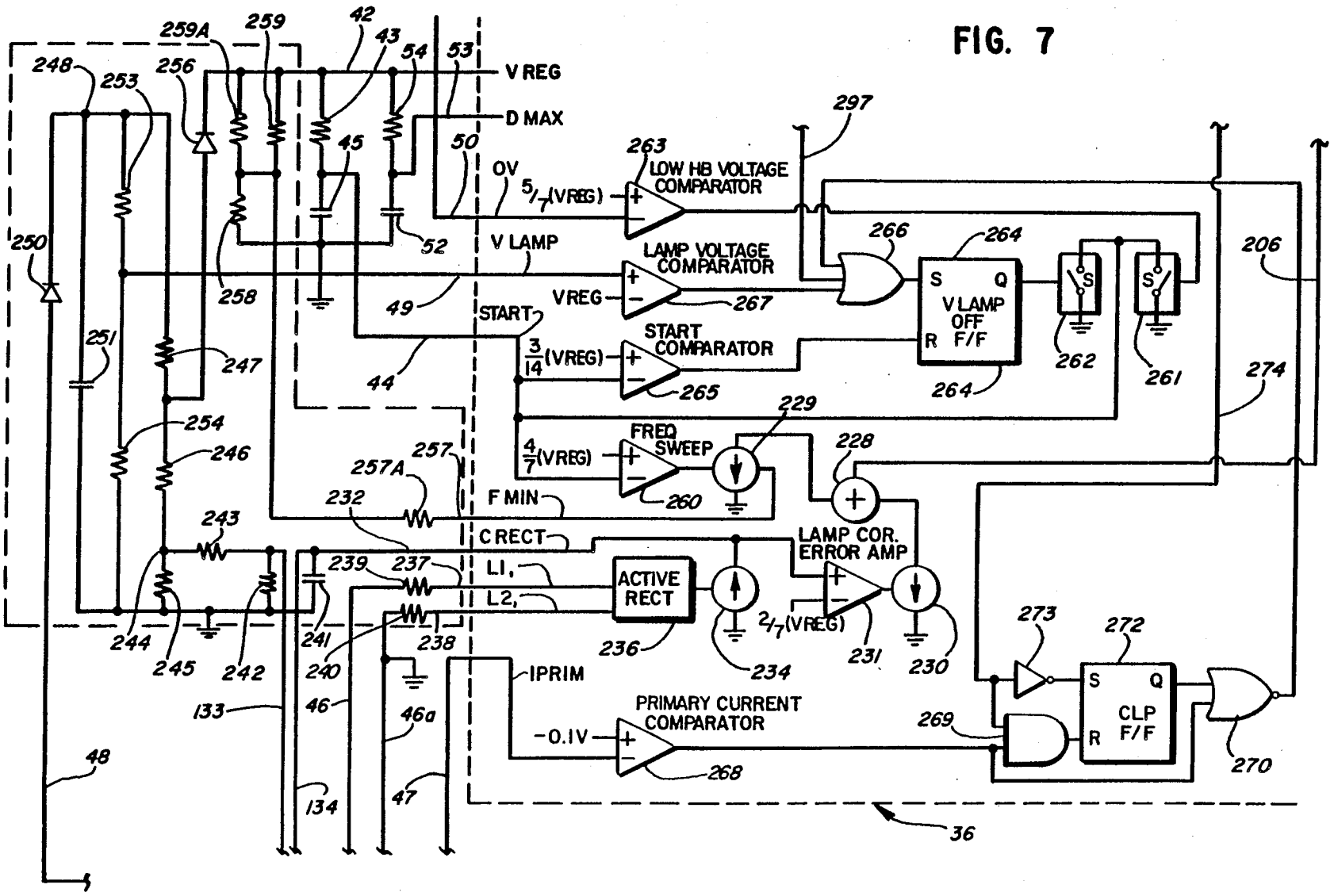
FIG. 7 is a schematic diagram showing another portion of logic and analog circuitry incorporated in a control circuit of the controller of FIG. 1 and operative for developing a frequency control signal, also showing connections to the dimming interface circuit of the invention.
Figure 8:
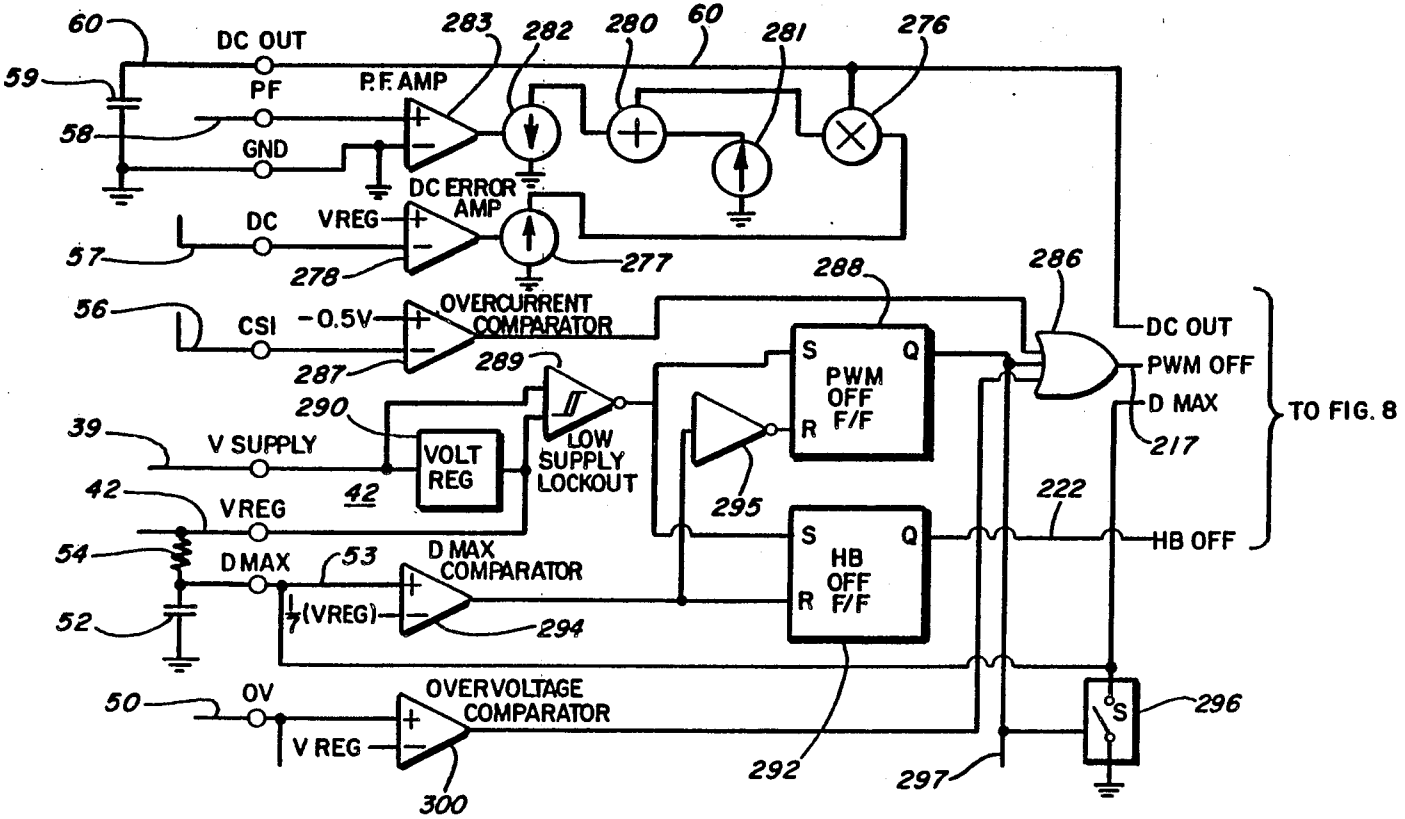
FIG. 8 is a schematic diagram of a third portion of logic and analog circuitry incorporated in a control circuit of the controller of FIG. 1 and operative for developing various control signals.

Both the pre-conditioner circuit 28 and the DC-AC converter circuit 24 include SMPS (switch mode power supply) circuitry and they are controlled by a control circuit 36 which responds to various signals developed by the output circuit 20 and the pre-conditioner circuit 28. The control circuit 36 is an integrated circuit in the illustrated controller and it includes logic and analog circuitry which is shown in FIGS. 6, 7 and 8 and which is arranged to respond to various signals applied from the pre-conditioner and output circuits 28 and 20 to develop and control the "GPC" and "GHB" signals on lines 37 and 38. FIG. 6 also shows the circuitry f the signal applying circuit 112 and the connections of the dimmer circuit 110 thereto.

The pre-conditioner circuit 28 preferably has a construction as disclosed in the aforementioned Fellows et al. application and is a variable duty cycle up-converter. High frequency gating pulses are applied from the control circuit 36 through the "GPC" line 37 to a gate of the MOSFET of the pre-conditioner circuit 28 to build-up current through a choke and store energy therein, such stored energy being transferred through a diode to a capacitor in "fly-back" operations at the ends of the gating pulses.

The DC-AC converter circuit 24 is a half-bridge converter circuit in the illustrated controller 10 and is supplied with a square wave gating signal "GHB" which is applied through a line 38 from the control circuit 36. It preferably has a construction as disclosed in the aforementioned Fellows et al. application, and includes a pair of MOSFETSs driven from a level shift transformer to effect alternate conduction thereof and to develop a square-wave output, with circuitry to protect the MOSFETs, shape and delay turn-on pulses and provide fast turn-offs. In accordance with an important feature, the gating signals "GPC" and "GHB" on lines 37 and 38 are synchronized and may be phase shifted to avoid interference problems and to obtain highly reliable operation. In the illustrated controller 10, they are developed at the same frequency.

Upon initial energization of the controller 10 and during operation thereof, an operating voltage is supplied to the control circuit 36 through a "VSUPPLY" line 39 from a voltage supply 40. A voltage regulator circuit within the control circuit 36 then develops a regulated voltage on a "VREG" line 42 which is connected to various circuits as shown.

As shown, the "VREG" line 42 is connected through a resistor 43 to a "START" line 44 which is connected through a capacitor 45 to circuit ground. Following energization of the controller 10, a voltage is developed on the "START" line 44 which increases as a exponential function of time and which is used for control of starting operations as hereinafter described in detail. In a typical operation, there is a pre-heat phase in which high frequency currents are applied to the filament electrodes of the lamps 11 and 12 without applying lamp voltages of sufficient magnitude to ignite the lamps. The pre-heat phase is followed by an ignition phase in which the lamp voltages are increased gradually toward a high value until the lamps ignite, the lamp voltages being then dropped in response to the increased load which results from conduction of the lamps.

Important features of the controller 10 relate to the control of lamp voltages through control of the frequency of operation, using components in the output circuit 20 to obtain resonance and using a range of operating frequencies which is offset from resonance. In the illustrated controller, the operating range is above resonance and a voltage is developed which increases as the frequency is decreased. For example, during the pre-heat phase, the frequency may be on the order of 50 KHz and, in the ignition phase, the frequency may then be gradually reduced toward a resonant frequency of 36 KHz, ignition being ordinarily obtained before the frequency is reduced to below 40 KHz.

Upon ignition and as a result of current flow through the lamps, the resonant frequency is reduced from a higher no-load resonant frequency of 36 KHz to a lower load-condition resonant frequency close to 20 KHz. The operating frequency is in a relatively narrow range around 30 KHz, above the load-condition resonant frequency. It is controlled in response to a lamp current signal which is developed within the output circuit 20 and which is applied to the control circuit 36 through current sense lines 46 and 46A, the line 46A being a ground reference line. When the lamp current is decreased in response to changes in operating conditions, the frequency is reduced toward the lower load-condition resonant frequency to increase the output power and oppose the decrease in lamp current. Similarly, the frequency is increased in response to an increase in lamp current to decrease the output power and oppose the increase in lamp current.

As hereinafter described, the use of an operating frequency which is above the load-condition resonant frequency has an important advantage in providing a capacitive load protection feature, operative to protect against a capacitive load condition which might cause destructive failure of transistors in the DC-AC converter circuit 24. Additional protection is obtained through the provision of circuitry within the output circuit 20 which develops a signal on a "IPRIM" line 47 which corresponds to the current in a primary winding of a transformer of the circuit 20 and which is applied to the control circuit 36. When the phase of the signal on line 47 is changed beyond a safe condition, circuitry within the circuit 36 operates to increase the frequency of gating signals on the "GHB" line 38 to a safe value, to provide additional protection of transistors of the DC-AC converter circuit 24.

During the pre-heat and ignition phases of operation, and also in response to lamp removal, a lamp voltage regulator circuit limits the maximum open circuit voltage across the lamps, operating in response to a signal applied through a voltage sense line 48 and to a "VLAMP" input line or terminal 49 of the control circuit 36, through interface circuitry which is shown in block form in FIG. 1 and which is shown in detail in FIG. 7 and described hereinafter in connection therewith. The lamp voltage regulator circuit operates to effect a re-ignition operation in which the operating frequency is rapidly switched to its maximum value and then gradually reduced from its maximum value to increase the operating voltage, to thereby make another attempt at ignition of the lamps.

The lamp ignition and re-ignition operation is prevented in response to a drop in the output voltage of the pre-conditioner circuit 28 below a certain value, through a comparator within circuit 36 which is connected through an "OV" line 50 to a voltage-divider circuit within the pre-conditioner circuit 28, the voltage on the "OV" line 50 being proportional to the output voltage of the pre-conditioner circuit 28.

The designation of line 50 as an "OV" line has reference to its connection to another comparator within circuit 36 which responds to an over voltage on the line 50 to shut down operation of the pre-conditioner circuit 28.

Another important protective feature of the controller relates to the provision of low supply lock-out protection circuitry, operative to compare the voltage on the "VSUPPLY" line 39 with the "VREG" voltage on line 42 and to prevent operation of the pre-conditioner circuit 28 and the DC-AC converter circuit 24 until after the voltage on line 39 rises above an upper trip-point. After circuits 28 and 24 are operative, the same circuitry operates to disable the circuits 28 and 24 when the voltage on line 39 drops below a lower trip-point. Then the DC-AC converter circuit 24 is not allowed to be enabled until after the voltage on line 39 exceeds the upper trip point and a minimum time delay has been exceeded. The required time delay is determined by the values of a capacitor 52 which is connected between a "DMAX" line 53 and ground and a resistor 54 connected between line 53 and the "VREG" line 42.

Another feature of the controller 10 relates to the provision of an overcurrent comparator within circuit 36 which is connected through a "CS1" line 56 to the pre-conditioner circuit 28 and which operates to disable application of gating signals from the "GPC" line 37 to the pre-conditioner circuit 28 when the current to the circuit 28 exceeds a certain value.

Additional features relate to the control of the duration of the gating signals applied from the "GPC" line 37 to the pre-conditioner circuit 28 to maintain the output voltage of the pre-conditioner circuit 28 at a substantially constant average value while also controlling the durations of the gating signals in a manner such as to minimize harmonic components in the input current and to obtain what may be characterized as power factor control. In implementing such operations, the control circuit 36 is supplied with a DC voltage on a "DC" line 57 which is proportional to the average value of the output voltage of the pre-conditioner circuit 28. Circuit 36 is also supplied with a voltage on a "PF" line 58 which is proportional to the instantaneous value of the input voltage to the pre-conditioner circuit 28. An external capacitor 59 is connected to the circuit 36 through a "DCOUT" line 60 and its value has an advantageous effect on the timing of the gating signals. It is also important for loop compensation of the pre-conditioner control circuit 28.

Figure 2:
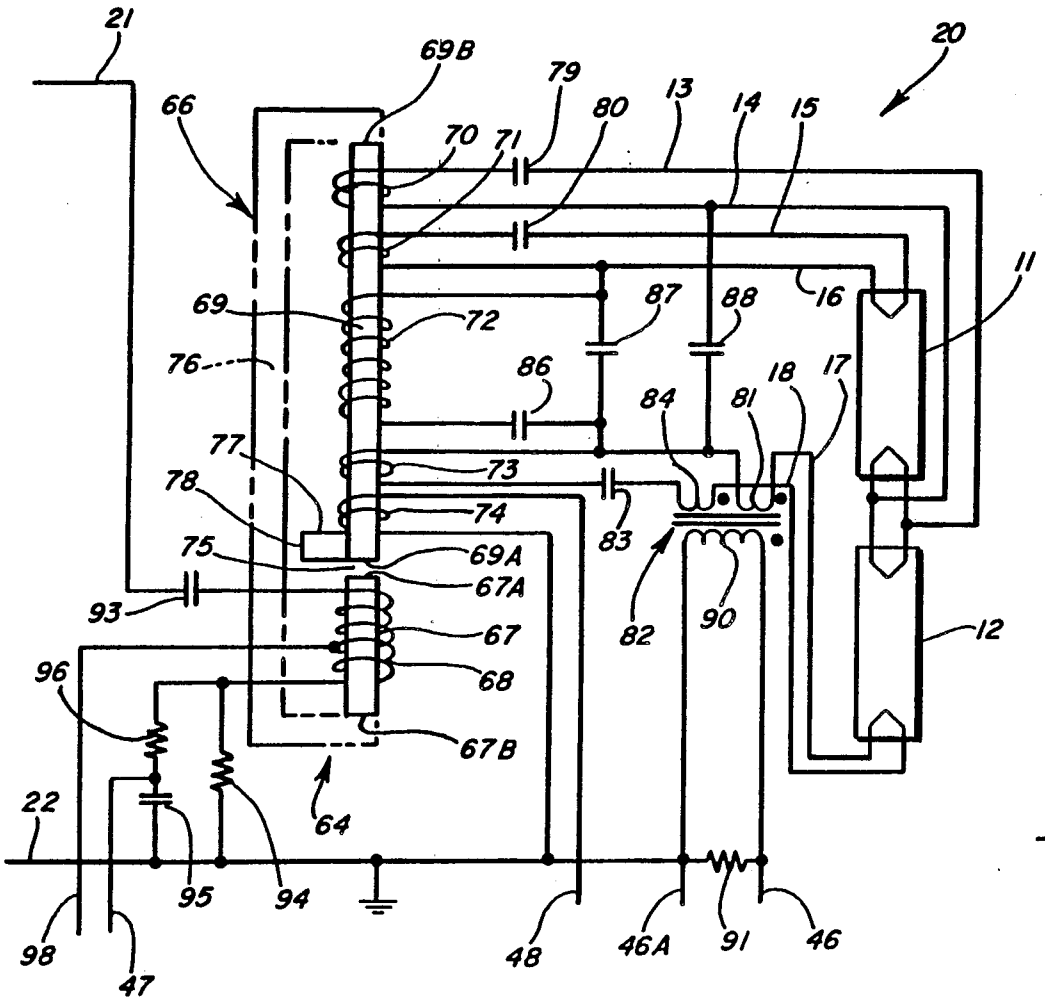
FIG. 2 is a circuit diagram of an output circuit of the fluroescent lamp controller shown in FIG. 1.

Output circuit 20 of controller 10 (FIG. 2)

As shown in FIG. 2, the output circuit 20 comprises a transformer 64 which is preferably constructed in accordance with the teachings in the Stupp et al. U.S. Pat. No. 4,453,109, the disclosure thereof being incorporated by reference. As diagrammatically illustrated, the transformer 64 comprises a core structure 66 of magnetic material which includes a section 67 on which a primary winding 68 is wound and a section 69 on which secondary windings 70–74 are wound, sections 67 and 69 having ends 67A and 69A adjacent to each other but separated by an air gap 75 and having opposite ends 67B and 69B interconnected by a low-reluctance section 76 of the core structure 66. In addition, although not used in a preferred embodiment, the core structure may optionally include a section 77 as illustrated, extending from the end 69A of the section 69 to a point which is separated by a air gap 78 from an intermediate point of the section 77. After ignition, a relatively high current flowing in the secondary windings 70–74 produces a condition in which the resonant frequency is reduced and the "Q" is also reduced.

Secondary windings 70, 71 and 73 are filament windings coupled to the heater electrodes through capacitors which protect against shorting of filament wires. Winding 72 is the lamp voltage supply winding and winding 74 supplies the lamp voltage signal on line 48. As shown, one end of winding 70 is connected through a capacitor 79 to the wire 13, the other end being directly connected to wire 14. One end of winding 71 is connected through a capacitor 80 to the wire 15 while the other end is directly connected to the wire 16. One end of winding 73 is connected to the wire 17 through a primary winding 81 of a current transformer 82 while the other end of winding 73 is connected to the wire 18 through a capacitor 83 and through a second primary winding 84 of current transformer 82. One end of winding 72 is connected to wire 16 while the opposite end thereof is connected through a capacitor 86 to a junction point which is connected through a capacitor 87 to the wire 16, through a capacitor 88 to the wire 14 and through the winding 81 to the wire 17. The current transformer 82 has a secondary winding 90 which is connected in parallel with a resistor 91 and to the current sense lines 46 and 46A.

One end of the primary winding 68 is connected through a coupling capacitor 93 to the input line 21 while the other end thereof is connected through a current sense resistor 94 to the other input line 22 which is connected to circuit ground. Coupling capacitor 93 operates to remove the DC component of a square wave voltage which is applied from the DC-AC converter circuit 24. The "IPRIM" line 47 is connected through a capacitor 95 to ground and through a resistor 96 to the ungrounded end of the current sense resistor 94. A tap on the primary winding 68 is connected through a line 98 to the voltage supply 40, to supply a square wave voltage of about ±20 volts for operation of the voltage supply 40 after a start operation as hereinafter described.

Line 98 is also connected to the dimmer circuit 110 of the invention, to supply the same square wave operating voltage thereto.

The output circuit operates as a resonant circuit, having a frequency determined by the effective leakage inductance and the secondary winding inductance and the value of capacitor 87 which operates as a resonant capacitor. Capacitor 87 is connected across the series combination of the two lamps 11 and 12 and is also connected across the secondary winding 72 through the capacitor 86 which has a capacitance which is relatively high as compared to that of the resonant capacitor 87 and which operates as a anti-rectification capacitor. Capacitor 88 is a bypass capacitor to aid in starting the lamps and has a relatively low value.

The graph of FIG. 3 shows the general type of operation obtained with an output circuit 20 such as illustrated. Dashed line 100 indicates a no-load response curve, showing the voltage which might theoretically be produced across the secondary winding 72 with frequency varied over a range of from 10 to 60 KHz, and without lamps in the circuit. As shown, the resonant frequency in the no-load condition is about 36 KHz and if the circuit were operated at that frequency, an extremely high primary current would be produced which might produce thermal breakdowns of transistors and other components. At a frequency of about 40 KHz, a relatively high voltage is produced, usually more than sufficient for lamp ignition. Dashed line 102 indicates the voltage which would be produced across the secondary winding 72 in a loaded condition, with a load which is electrically equivalent to that provided with lamps in the circuit. The resonant frequency at the loaded condition is a substantially lower frequency, close to 20 Khz as illustrated. The resonant peak in the loaded condition is also of broader form and of substantially lower magnitude due to the resistance of the load. It should be understood that resonant peaks are shown for explanatory purposes and that the operating range is offset from resonance.

Actual operation is indicated by a solid line in FIG. 3. Initially, the frequency of operation is at a relatively high value, at about 50 KHz as illustrated and as indicated by point 105. At this point, the voltage across the lamps is insufficient for ignition, but a relatively high voltage is developed across the heater windings 70, 71 and 73. During the pre-heat phase, the frequency is maintained at or near the point 105. Then a pre-ignition phase is initiated in which the frequency is gradually reduced toward the no-load resonant frequency of 36 KHz, following the no-load response curve 100. The lamps 11 and 12 will ordinarily ignite at or before reaching a point 106 at which the frequency is about 40 KHz and the voltage is about 600 volts peak.

After ignition, the effective load resistance is decreased, shifting the operation to the load condition curve 102. In response to load current after ignition, the frequency of operation is rapidly lowered to a point 108 which is at a frequency of about 30 KHz, substantially greater than the loaded condition resonant peak 103. Operation is then continued within a relatively narrow range in the neighborhood of the point 108, being shifted in response to operating conditions to maintain the lamp current at a substantially constant average value.

Figure 4A:
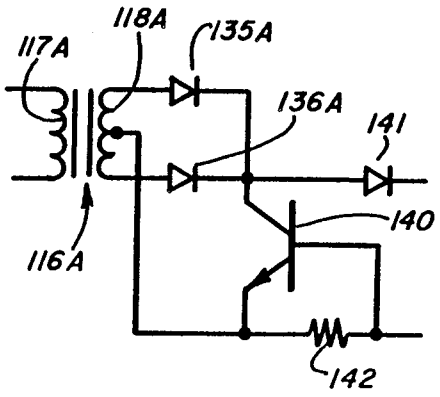
FIG. 4A shows a circuit using a center-tapped transformer winding and two diodes, usable as an alternative to a circuit of FIG. 4 which uses four diodes.
Figure 4:
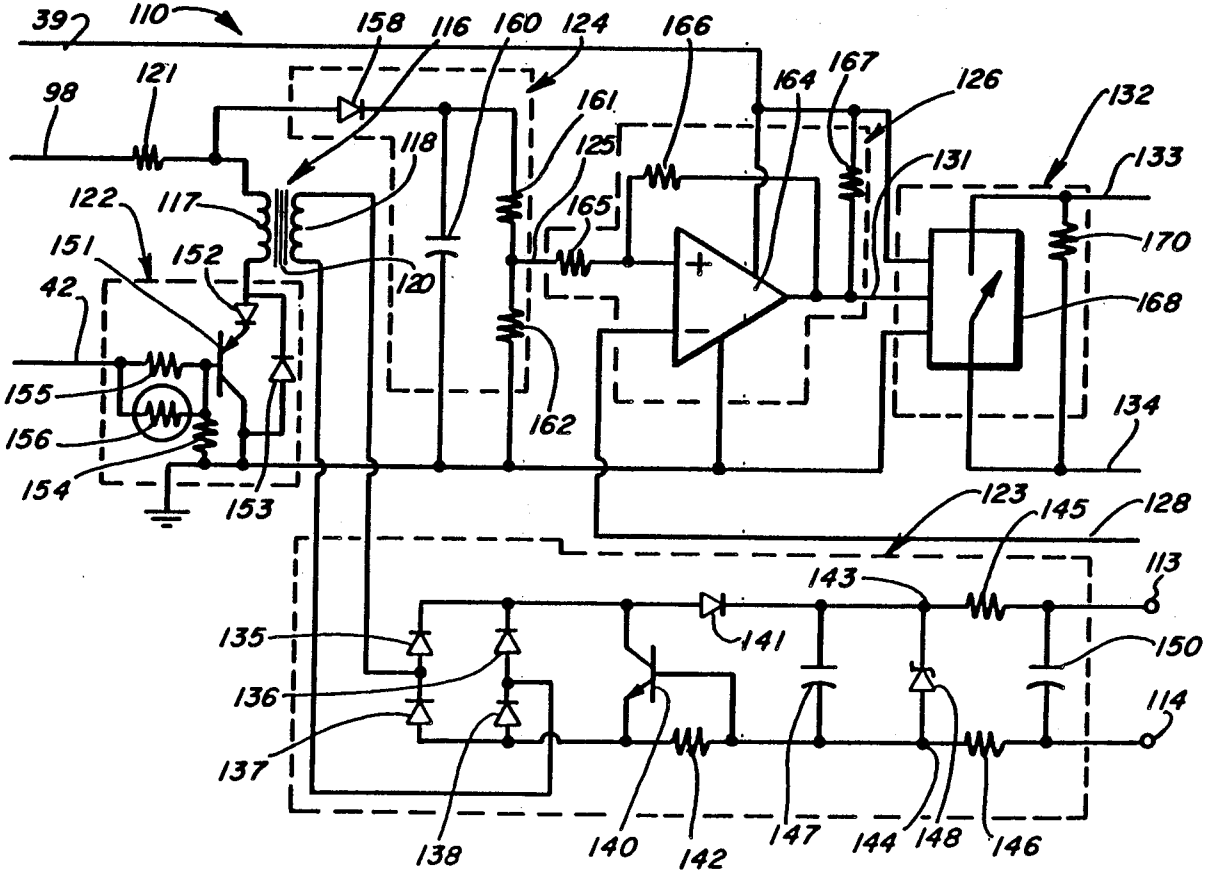
FIG. 4 is a circuit diagram of the dimming interface circuit shown in FIG. 1.

Dimmer Interface circuit (FIG. 4)

FIG. 4 illustrates the dimming interface circuit 110 which is one preferred form of circuit constructed in accordance with the principles of the invention. As aforementioned, the interface circuit 110 is connected to control signal-applying circuitry 112 of the controller 10 to control the energization of the fluorescent lamps 11 and 12 in accordance with a low voltage DC control signal applied to input terminals 113 and 114 of the interface circuit 110. It provides high voltage isolation between non-grounded circuits of the controller 10 and grounded dimming controls which are connected to the terminals 113 and 114 and it converts a low voltage DC input control signal of a standardized form to a form which is compatible with the circuitry of the controller 10. It is energized from the controller 10 so that no separate power supply is required.

The dimmer interface circuit 110 includes a transformer 116 which has primary and secondary windings 117 and 118 on a core 120 of magnetic material to provide a high coefficient of magnetic coupling therebetween. The controller 10 provides a high frequency AC source for energization of the primary winding 117. The upper end of the primary winding 117 is connected through a resistor 121 to the line 98 which is connected to a tap of the primary winding 68 of the transformer 64 of the output circuit 20, as shown in FIG. 4. As aforementioned, a square wave voltage of about ±20 volts is developed at the line 98 and is used for operation of the voltage supply 40 after completion of a start operation. The lower end of the primary winding 117 is connected to ground through a level shift circuit 122.

The secondary winding 118 is connected to a clipping circuit 123 which operates to limit or clip the voltage across the secondary winding to a value which is proportional to a voltage applied to input terminals 113 and 114 and which thereby limits the voltage across the secondary winding 118. The AC voltage across the primary winding 117 is limited to a corresponding value as a result of there being a tight or high coefficient of coupling between the primary and secondary windings 117 and 118 and as a result of the impedance in series with the primary winding which is provided by the resistor 121.

The controlled AC voltage which is developed across the primary winding 117, plus a level shift voltage developed by the level shift circuit 122, is applied to a peak detector and scaling circuit 124. Circuit 124 develops a corresponding DC voltage which is used for controlling the effective value of a resistive impedance which is connected to the signal applying circuitry 112 and which operates to control the controller 10 in a manner to control energization of the lamps 11 and 12 in a manner as hereinafter described.

To so provide a controlled resistive impedance, the output of the peak detector and scaling circuit 124 is connected through a line 125 to one input of a comparator circuit 126 which has a second input connected through a line 128 to the control circuit 36, line 128 being connected through a capacitor 130 to ground. As hereinafter described, the capacitor 130 is charged and discharged to develop a periodically varying triangular voltage at the line 128. Through comparison of the triangular voltage so developed with the output voltage of the peak detector and scaling circuit 124, a pulse-width-modulated square wave signal is developed at the output of the comparator circuit 126 which has a duty cycle controlled by the voltage at input line 125 and which is applied through an output line 131 to an analog switch circuit 132. Switch circuit 132 is connected through a line 133 to the control circuit 36 and through a line 134 to the signal-applying circuit 112, to control operation of the controller 10 in a manner as hereinafter described.

The clipping circuit 123 comprises four diodes 135–138 which form a bridge rectifer circuit having input terminals connected to the secondary winding 118 and having output terminals which are connected to the collector and emitter of a transistor 140 and also through a diode 141 and a resistor 142 to circuit points 143 and 144 which are connected through resistors 145 and 146 to the input terminals 113 and 114. The base of transistor 140 is connected to circuit point 144. A capacitor 147 and a Zener diode 148 are connected between circuit points 143 and 144 and a capacitor 150 is connected between lines 113 and 114. Zener diode 148 limits the voltage between circuit points 143 and 144 to a safe value.

In operation, a DC control voltage is applied between the input terminals 113 and 114 which may have a magnitude of between 1 and 10 volts, by way of example. The transistor 140 conducts to limit the output voltage of the rectifier circuit to a value which is only slightly greater than the control of voltage applied to the input terminals 113 and 114. It is noted that transistor 140 operates as a current amplifier to limit the required sinking current through the control voltage source to a relatively small value. A control current flows from whichever terminal of the secondary winding 118 is positive and through the corresponding one of the diodes 135 or 136, thence through diode 141 and resistor 145 to the terminal 113, thence through the control voltage source to the terminal 114, thence through the resistor 146, parallel combination of the resistor 142 and the base-emitter junction of transistor 140 and thence through the diode 137 or the diode 138 to whichever of the terminals of the secondary winding is negative. Through the amplification of the transistor 140, a loading current flows therethrough of sufficient magnitude to limit the peak voltage across the secondary winding 118 to a value only slightly above the value of the control voltage and to reliably obtain a corresponding voltage across the primary winding for control of lamp energization. The control current is of very small magnitude, it flows in a direction to supply energy to the control voltage source and it is at a minimum when the control voltage is at a maximum. As a result, control lines from a number of dimming interface circuits can be connected in parallel to a common control voltage source, when desired. Due to the the transformer 116, there is no DC path from the controller circuitry to the input terminals and the controller circuitry is isolated from the input terminals and voltage sources and/or the circuitry of other controllers having interfaces connected to the input terminals. The resistors 145 and 146, together with capacitors 147 and 150, provide additional isolation in providing filtering to substantially prevent transmission to the input terminals 113 and 114 of switching noise generated in the controller circuitry.

The bridge circuit formed by diodes 135–138 operates to transform the uni-directional DC clipping action provided by transistor 140 into a bi-directional AC voltage clipping action to limit the AC voltage in the terminals of the secondary winding 118. Preferably, the diodes 135-138 are Schottky diodes having low voltage drop thereacross.

Since there is a tight or high coefficient of coupling between the primary and secondary windings 117 and 118, the AC voltage across the primary winding 117 corresponds to that across the secondary winding 118. The turns ratio of the transformer 116 may preferably be 1:1 so that the two voltages are substantially the same. The resistor 121 has a value which is low enough to allow development of the desired range of voltage across the primary winding 117 while limiting current and preventing undue loading of the AC source which is provided by the line 98 from the controller 10.

FIG. 4A shows alternative loading circuit which includes a transformer 116A having a primary winding 117A and having secondary winding 118A provided with a center tap which is connectable to the emitter of transistor 140 as shown, the opposite ends of the secondary winding 118A being connectable through two diodes 135A and 136A to the collector of transistor 140 and also to the anode of diode 141. It will be recognized that this alternative circuit operates in a manner similar to that of FIG. 4. The control current is amplified to apply substantially equal loading currents in both half cycles and to limit the voltage across the primary winding 117A to a value corresponding to the control voltage.

The level shift circuit 122 comprises a transistor 151 the emitter of which is connected through a protective diode 152 to the lower end of the primary winding 117 and the collector of which is connected to ground. A reverse poled diode 153 is connected in parallel with the series combination of transistor 151 and diode 152 so that current may be conducted in both positive and negative half cycles of the applied AC voltage. The base of the transistor 151 is connected through a resistor 154 to ground and through a resistor 155 to the aforementioned "VREG" line 42 at which a regulated voltage is supplied from the control circuit 36. Preferably, a thermistor 156 is connected in parallel with resistor 155.

The level-shift circuit 122 operates to add a positive DC voltage level which is approximately equal to the voltage at the "VREG" line 42, the transistor 151 being operative as a buffer to limit the required current drain on the "VREG" line 42. The provision of the thermistor 156 is important for improving the system performance, especially at high temperatures. It is found that without the thermistor 156, the dimming operation has a strong temperature dependence due to cumulative effects of diode voltage drops and that at low dim levels, lamp current can shift as much as about 32% over a 25 Deg. C. to 80 Deg. C. temperature range. In the illustrated circuit, the negative temperature coefficient thermistor is used in conjunction with resistors 154 and 155 to form a voltage divider network and to change the magnitude of the level shift in a direction to offset the temperature effects of all diode voltage drops in the dimming circuit.

The peak detector and scaling circuit 124 comprises a diode 158 the anode of which is connected to the upper end of the primary winding 117 and the cathode of which is connected to ground through a capacitor 160 and through a voltage divider formed by resistors 161 and 162, the output line 125 being connected to the junction of resistors 161 and 162. During half cycles when the upper end of the primary winding 117 is positive, the capacitor 160 is charged to a level equal to the voltage across the primary winding 117 plus the voltage developed by the level shift circuit 122. A certain fraction of the voltage developed across capacitor 160 is applied to the comparator circuit, as determined by the ratio of the resistance of resistor 161 to the total resistance of resistors 161 and 162. It is found that for optimum performance, such resistances should be correlated to the resistances of the resistors 154 and 155 and the characteristics of the thermistor 156 in the level shift circuit.

The comparator circuit 126 comprises a comparator 164 which is supplied with an operating voltage from the "VSUPPLY" line 39. A minus input of comparator 164 is connected through the line 128 to the control circuit 36. A plus input is connected through a resistor 165 to the output line 125 of the peak detector and scaling circuit 124. The output of the comparator 164 is connected to the line 131, through a resistor 166 to its plus input and through a resistor 167 to the "VSUPPLY" line 39.

As aforementioned, the capacitor 130 is charged and discharged by the control circuit 36 to develop a periodically varying triangular wave form at the line 128. By way of example, the voltage may vary from about 2.48 volts to about 4.6 volts at a frequency of on the order of 30 KHz. The comparator 164 is triggered to an "on" state when the voltage at its plus input, applied from the peak detector and scaling circuit 124, is greater than the level of the triangular wave form applied to the minus input through the line 128. Thus, pulses are developed at the output line 131 having durations controlled by the level of the signal applied at the line 125. The resistor 166 provides positive feedback and hysteresis and operates to produce cleaner noise-free output transmission from the comparator 164 without significantly affecting the threshold level of the comparator 164.

The analog switch circuit 132 comprises a integrated circuit analog switch component 168 which is supplied with an operating voltage from the line 39. A resistor 170 is connected across the switch 168. By way of example, the switch 168 may be one-fourth of a type MC14066BCP Quad CMOS analog switch. It provides an effective short circuit or open-circuit depending upon the control signal it receives from the comparative circuit 126 through the line 131, a short circuit being developed from a "high" input and an open circuit being developed from a "low" input.

Figure 5:
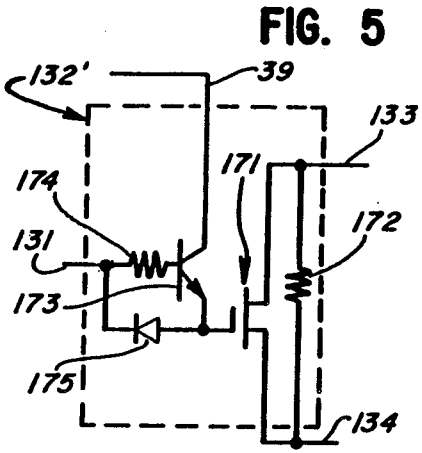
FIG. 5 is a circuit diagram of a modified form of analog switch circuit for use in the dimming interface circuit of FIG. 4.

Modified Analog Switch Circuit (FIG. 5)

FIG. 5 shows a modified analog switch circuit 132'. It comprises a MOSFET switch 171 connected between the lines 133 and 134, in parallel with a resistor 172. The gate of the MOSFET switch 171 is connected to the emitter of a transistor 173 the collector of which is connected to the supply line 39. The base of the transistor 173 is connected through a resistor 174 to the output line 131 from the comparator circuit 126 and a diode 175 is connected between line 131 and the gate of the MOSFET 171. The transistor 173, operating as an emitter-follower, converts the relatively high impedance collector output from comparator 164 to a lower impedance, to speed up the gate rise-time of the MOSFET 171. The diode 175 provides a directed discharge path between the gate of the MOSFET 171 and the output of the comparator 164.

Control circuit 36 (FIGS. 6–9)

Figure 9:
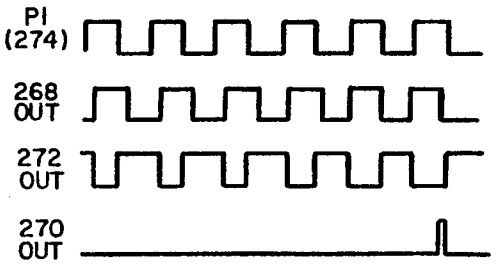
FIG. 9 is a graph illustrating the waveforms produced in phase comparison circuitry shown in FIG. 7, for explanation of the operation thereof.

Circuitry within the control circuit 36 and associated external components are shown in FIGS. 6, 7 and 8. FIG. 6 shows pulse width oscillator and oscillator circuitry for producing the "GPC" and "GHB" gating signals on lines 37 and 38; FIG. 7 shows circuitry for applying variable frequency and control signals to the oscillator circuity shown in FIG. 6, also showing the signal-applying circuitry 112 shown in block form in FIG. 1; and FIG. 8 shows circuitry for applying control signals to the pulse width modulator circuitry shown in FIG. 6. FIG. 9 is a graph illustrating the waveforms produced in phase comparison circuitry shown in FIG. 7, for explanation of the operation thereof.

Pulse width modulator and oscillator circuitry (FIG. 6)

As shown in FIG. 6, the "GPC" and "GHB" lines 37 and 38 are connected to the outputs of "PC" and "HB" buffers 191 and 192 of he control circuit 36. The input of the "PC" buffer 191 is connected to the output of an AND gate 193 which has three inputs including one which is connected to the output of a "PC" flip-flop 194 operative for controlling the generating of pulse width modulated pulses. The input of the "HB" buffer 192 is connected to the output of a comparator 195 having inputs connected to the two outputs of a "HB" flip-flop 196 which is controlled to operate as an oscillator and generate a square-wave signal.

Circuits used for the "HB" oscillator flip-flop 196 are described first since they also control the time at which the "PC" flip-flop 194 is set in each cycle, reset of the "PC" flip-flop 194 being performed by other circuits to control the pulse width. As shown, the set input of the "HB" flip-flop 196 is connected to the output of a comparator 197 which has a plus input connected through a "CVCO" line 198 to an external capacitor 200. The minus input of comparator 197 is connected to a resistance voltage divider, not shown, which supplies a voltage equal to a certain fraction of the regulated voltage "VREG" on the line 42, a fraction of 5/7 being indicated in the drawing. The reset input of the "HB" flip-flop 196 is connected to the output of an OR gate 201 which has one input connected to the output of a second comparator 202. The minus input of comparator 202 is connected to the "CVCO" line 198, while the plus input thereof is connected to a voltage divider which supplies a voltage equal to a certain fraction of the "VREG" voltage, less than that applied to the minus input of comparator 197, a fraction of 3/7 being indicated in the drawing.

The "CVCO" line 198 is connected through a current source 204 to ground. Current source 204 is bi-directional and controlled through a stage 205 from the output of the "HB" flip-flop 196 to charge the capacitor 200 at a certain rate when the "HB" flip-flop 196 is reset and discharge the capacitor 200 at the same rate when the "HB" flip-flop 196 is set. The rate of charge and discharge is the same and is maintained at a constant rate which is adjustable under control by a control signal on an "FCONTROL" line 206.

In the operation of the "HB" oscillator circuit as thus far described, the capacitor 200 is charged through the source 204 until the voltage reaches the upper level set by the reference voltage applied to comparator 197 at which time the flip-flop 196 is set to switch the source 204 to a discharge mode. The capacitor 200 is then discharged until the voltage reaches the lower level set by the reference voltage applied to comparator 202 at which time the flip-flop 196 is again reset to initiate another cycle. The frequency is controlled by the charge and discharge rate which is controlled by the control signal on the "FCONTROL" line 206.

In the pulse width modulator circuitry, a current source 208 is provided which is connected between ground and a "CP" line 209 to an external capacitor 210 and which is also controlled by the signal on the "FCONTROL" line 206, current source 208 being operative only in a charge mode. A solid state switch 211 is connected across capacitor 210 and is closed when the flip-flop 194 is reset. When a signal is developed at the output of comparator 202 to reset the "HB" flip-flop 196, it is also applied to the set input of the "PC" flip-flop 194 which then operates to open the switch 211 and to allow charging of the capacitor 210 at the constant rate set by the control signal on the "FCONTROL" line 206.

In normal operation, charging of the capacitor 210 continues until its voltage reaches the level of signal on a "DCOUT" line 60 which is developed by other circuitry within the circuit 36 as hereinafter described in connection with FIG. 8.

The "DCOUT" signal on line 60 is applied to the minus input of a comparator 214, the plus input of which is connected to the "CP" line 209. The output of the comparator 214 is applied through an OR gate 215 and another OR gate 216 to the reset input of the "PC" flip-flop 194 which operates to close the switch 211 and to discharge the capacitor 210 and place the line 209 at ground potential. The line 209 remains at ground potential until the flip-flop 194 is again set in response to a signal from the output of the comparator 202.

The "PC" flip flop 194 may also be reset in response to any one of three other events or conditions. The second input of the OR gate 216 is connected to a "PWMOFF" line 217 which is connected to other circuitry within the control circuit 36, as described hereinafter in connection with FIG. 8. The second input of the OR gate 215 is connected to the output of a comparator 218 which has a plus input connected to the "CP" line 209 and which has a minus input connected to a resistance voltage divider, not shown, which supplies a voltage equal to a certain fraction of the regulated voltage "VREG" on the line 42, a fraction of 9/14 being indicated in the drawing. If, at any time after the flip flop 194 is set, the voltage on line 209 exceeds the reference voltage applied to the minus input of comparator 218, the flip flop 194 will be reset. Thus, there is an upper limit on the width of the generated pulse.

A third input of the OR gate 215 is connected to the output of a comparator 220 which has a plus input connected to the line 209 and a minus input connected to the aforementioned "DMAX" line 53. The "DMAX" line 53 is also connected to other circuitry within the control circuit 36 and the operation in connection with the "DMAX" line 53 is described hereinafter.

Provisions are made for disabling both the half bridge oscillator and pulse width modulator circuits in response to a signal on a "HBOFF" line 222 which is connected to solid state switches 223 and 224 operative to connect the "CVCO" and "CP" lines 198 and 209 to ground. Line 222 is also connected to a second input of the OR gate 201 to reset the "HB" flip flop 196. An inverter circuit 225 is connected between the set input of flip flop 194 and an input of the AND gate 193. Another inverter 226 is connected between the output of the OR gate 215 and a third input of the AND gate 193, for the purpose of insuring development of an output from the pulse width modulator circuit only under the appropriate conditions.

Frequency control and signal-applying circuitry (FIG. 7)

FIG. 7 shows frequency control circuitry which is incorporated within the control circuit 36 and also shows the signal-applying circuitry 112 to which the dimming interface circuit 110 of the invention is connected.

The frequency control circuitry of FIG. 7 operates to control the level of the frequency control signal on the "FCONTROL" line 206 which is applied to the current sources 204 and 208 of the oscillator and pulse-width modulator circuitry of FIG. 6. As shown in FIG. 7, line 206 is connected to the output of a summing circuit 228 which has inputs connected to two current sources 229 and 230. The current source 229 is controlled in conjunction with starting operations and operations and in conjuction with "retry" operations made when the lamps fail to ignite in a starting operation. The current source 230 is controlled in response to output lamp current.

In normal operation, after ignition, the current of the current source 229 is constant, changes in frequency being controlled solely by the current source 230. Current source 230 is connected to the output of a lamp current error amplifier 231 which has a minus input supplied with a reference voltage developed by voltage divider (not shown) within the circuit 36, a reference Voltage of 2/7 of the regulated voltage "VREG" being indicated.

The plus input of the amplifier 231 is connected to a "CRECT" line 232 which is connected through the signal-applying circuit 112 to one output line 133 of the dimming interface circuit 110 of the invention. The plus input of amplifier 231 is also connected through a current source 234 to ground. Current source 234 is controlled by an active rectifier 236 having inputs which are connected through "LI" and "LI2" lines 237 and 238 and external resistors 239 and 240 to the current sense lines 46 and 46A. As shown, the current sense line 46A is a ground interconnect line.

In the signal-applying circuitry 112, the "CRECT" line 232 is connected through a capacitor 241 to ground and also to the output line 134 from the dimming interface circuit 110 of the invention. The second output line 133 of the dimming interface circuit 110 is connected through a resistor 242 to ground and is also connected through a resistor 243 to a circuit point 244 which is connected through a resistor 245 to ground and through resistors 246 and 247 to a circuit point 248. Circuit point 248 is connected through a diode 250 to the voltage sense line 48, through a capacitor 251 to ground and also through a pair of resistors 253 and 254 to ground, the "VLAMP" line 49 being connected to the junction between resistors 253 and 254. A diode 256 is connected between the junction between resistors 246 and 247 and the "VREG" line 42 to limit the voltage at that junction to the regulated voltage on line 42.

In operation, amplifier 231 is controlled by summation of a first control signal applied from the current source 234 and a second control signal applied from the "CRECT" line 232. The amplifier 231, in turn, controls the current source 230 which operates through the summing circuit 228 and line 206 to control the current source 204 (FIG. 6) and thereby control the frequency of operation.

The first control signal, which is applied from the current source 234, is controlled by the active rectifier 236 to be controlled in accordance with the lamp current which is sensed by the current transformer 82. The lamp current is thereby regulated at a value which is dependent upon the second signal which is from the dimming interface circuit 110 of the invention. In particular, the dimming interface circuit 110 controls the effective resistance between the "CRECT" line 232 and the junction between resistors 242 and 243 and thereby controls the signal applied through the line 232 to the lamp correction error amplifier 231. Operation is thereby controlled in accordance with the control signal applied to the input terminals 113 and 114 of the dimming circuit 110. The diode 256 serves to limit the voltage developed at the "CRECT" line during start-up. The values of the resistors 242, 243, 245, 246 and 247 are determined by the characteristics of the lamps and other components and may be changed for different ratings or types of lamps.

To establish a minimum frequency of operation, a control current is applied to the current source 229 through a "FMIN" line 257 which is connected through a resistor 257A to a circuit point which is connected through a resistor 258 to ground and through a pair of resistors 259 and 259A to the "VREG" line 42.

The current source 229 is also controlled by a "frequency sweep" amplifier 260 which has a plus input connected to a reference voltage source, a reference of 4/7 of the regulated voltage on line 42 being shown. The minus input of amplifier 260 is connected to the "START" line 44 and is also connected through two switches 261 and 262 to ground. Switch 261 is controlled by a comparator 263 to be closed when the output voltage of the pre-conditioner circuit 28 is less than a certain threshold value. As shown, a reference voltage of 5/7 of the regulated voltage on line 42 is applied to its plus input and its minus input is connected to the "OV" line 50.

The switch 262 is connected to an output of a "VLAMP OFF" flip-flop 264 which has a reset input connected to the output of a "START" comparator 265. The minus input of comparator 265 is connected to the "START" line 44 and the plus input thereof is connected to a reference voltage source, a reference of 3/14 of the regulated voltage on line 42 being indicated. The set input of the flip-flop 264 is connected to the output of an OR gate 266 which has inputs for receiving any one of three signals which can operate to set the "VLAMP OFF" flip-flop and to cause closure of the switch 262.

One input of OR gate 266 is connected to the output of a lamp voltage comparator 267, the minus input of comparator 267 being connected to the "VREG" line 42 and the plus input thereof being connected to the "VLAMP" line 49. When the lamp voltage exceeds a certain value, a signal is applied from the lamp voltage comparator 267 to set the flip-flop 264 and to thereby effect closure of the switch 262 and grounding of the "START" line 44.

A second input of OR gate 266 is connected to be responsive to setting of a flip-flop of pulse width modulator circuitry shown in FIG. 8 and described hereinafter.

A third input of OR gate 266 is connected to be responsive to a signal which is generated by circuitry described hereinafter, to effect operation of the flip-flop 264 when the phase of the signal on the "IPRIM" is changed beyond a safe value.

In the start operation, the current of the current source 229 has a maximum value and the current of source 230 has a minimum value and the frequency is at a certain maximum value, such as 50 KHz. The voltage applied by the output circuit, once the pre-conditioner and DC-AC converter circuits 28 and 24 are operative, is sufficient for heating the lamp filaments but insufficient for ignition of the lamps. When power is initially supplied to the controller 10, the switch 261 is closed and the switch 262 is open. After the voltage on the "OV" line 50 exceeds 5/7 (VREG), the switch 261 is opened by the low HB voltage comparator 263. Then the voltage of the "START" line 44 will start to rise exponentially in response to current flow through the resistor 43.

When the voltage of the "START" line 44 approaches a certain level, determined by the reference voltage applied to the frequency sweep amplifier 260, at around 4/7 ("VREG"), the ignition phase is initiated. At this time, the frequency sweep amplifier 260 starts to decrease the current through the current source 229 to operate through the summing circuit 228 and the line 206 to decrease the frequency of operation. When the frequency is decreased to a certain value, the lamps will ignite, usually at a frequency above 40 KHz. The lamp operation phase is then initiated. At this time, the effective resonant frequency of the output circuit is lowered substantially. At the same time, the current through the lamps is sensed by the current transformer 82 and a control signal is developed by the active rectifier 236 to operate to drop the frequency to a range appropriate for operation of the lamps, at around 30 KHz.

If the lamps should fail to ignite during the ignition phase, the frequency will continue to be lowered and the lamp voltage will continue to increase until voltage on the "VLAMP" line 49 reaches a certain value, at which time the lamp voltage comparator 267 will apply a signal through the OR gate 266 to set the flip-flop 264 and to effect momentary closure of the switch 262 to ground the "START" line 44 and discharge the capacitor 45. The voltage of "START" line 44 is then dropped below a certain value and a reset signal is applied from the start comparator 265 to reset the flip-flop 264. Then the voltage of the "START" line will again start to rise exponentially. When it reaches a certain higher value, the ignition phase is again initiated through operation of the frequency sweep comparator 260 in the manner as above described. Thus one or more "retry" operations are effected, continuing until ignition is obtained, or until energization of the controller is discontinued.

As aforementioned, the flip-flop 264 may also be operated to a set condition when the phase of the signal on the "IPRIM" line changes beyond a safe value. The circuitry shown in FIG. 7 further includes a primary current comparator 268 having a minus input connected to the "IPRIM" line 47 and having a plus input connected to a source of reference voltage, which is not shown but which may supply a reference voltage of −0.1 volts as indicated. The output of the comparator 268 is connected to one input of an AND gate 269 and is also connected to one input of a NOR gate 270. The output of the AND gate 269 is connected to the reset input of a "CLP" flip-flop 272 having an output connected to a second input of the NOR gate 270. The set input of the flip-flop 272 is connected to the output of an inverter 273. The input of the inverter 273 and a second input of the AND gate 269 are connected together through a line 274 to the half bridge oscillator circuitry shown in FIG. 6, being connected to the output of the half bridge flip-flop 196. The output of the NOR gate 270 is connected through the OR gate 266 to the set input of the flip-flop 264.

In operation, the output of the NOR gate 270 is high only when the flip-flop 272 is reset and, at the same time, the output of the primary current comparator 268 is low. Such conditions can take place only when the phase of the current on the line 47 relative to the signal applied on the line 274 is changed in a leading direction beyond a certain threshold angle which is determined by the reference voltage applied to the primary current comparator 268. The signal on line 274 is supplied from the output of the "HB" flip-flop 196 (FIG. 6) which supplies the gating signals to the DC-AC or half bridge converter circuit 24.

FIG. 9 is a graph which shows the relationships of the voltages on line 274 and at the outputs of comparator 268, flip-flop 272 and NOR gate 270 as the phase of the signal on the "IPRIM" line is advanced in a leading direction. When the trailing edge of the output of comparator 268 occurs before the leading edge of the output of flip-flop 272, the output of NOR gate 270 goes high and is applied through the OR gate 266 to set the "VLAMP" flip-flop 264, and to cause the frequency to sweep high in the manner as described above.

The circuitry shown in FIG. 7, including components 268, 269, 270, 272 and 273, is operative in the arrangement as shown for checking only the conduction of one of the MOSFETS of the circuit 24. Normally, it will provide more than adequate protection with respect to the other MOSFET, using the circuitry as shown and described. However, it will be understood that for additional protection or with other types of converter circuits, a phase comparison arrangement as shown may be provided for each other MOSFET or other type of transistor of the converter.

Pulse Width Modulator Control Circuitry (FIG. 8)

The voltage on the "DCOUT" line 60, which controls the width of the pulses generated by the pulse width modulator circuit of FIG. 8, is developed at the output of a multiplier circuit 276 which has one input connected to ground through a current source 277 which is controlled by a DC error amplifier 278. The plus input of the amplifier 278 is connected to the voltage regulator line 42 while the minus input thereof is connected to the "DC" line 57 on which a voltage is applied proportional to the output voltage of the pre-conditioner circuit 28. The other input of the multiplier circuit 276 is connected to the output of a summing circuit 280 which is connected to two current sources 281 and 282.

Current source 281 supplies a constant reference or bias current in one direction while current source 282 supplies a current in the opposite direction under control of the voltage on the "PF" line 58. The source 282 is connected to the output of a "PF" amplifier 283 which has a plus input connected to line 58 and a minus input connected to ground. In operation, the input waveform is, in effect, inverted through control of the current source 282 and then added to a reference determined by the current source 281, the waveform being multiplied by a value proportional to the average output of the pre-conditioner circuit 28.

With proper adjustment, a control of the width of each gating pulse is obtained such that the average input current flow during the short duration of each complete gating pulse cycle is proportional to the instantaneous value of the input voltage to the pre-conditioner circuit. At the same time, the pulse widths are controlled through the current source 277 to control the total energy transferred in response to all of the high frequency gating pulses applied during each complete half cycle of the applied full wave rectified low frequency 50 or 60 Hz voltage. The result is that the output voltage of the pre-conditioner circuit 28 is substantially constant while at the same time, the input current waveform is proportional to and in phase with the input voltage waveform, so that the input current waveform is sinusoidal when the input voltage waveform is sinusoidal.

The "PWMOFF" line 217 is connected to the output of an OR gate 286 which has one input connected to the output of an over-current comparator 287. The plus input of comparator 287 is connected to a reference voltage source (not shown) which may supply a voltage of −0.5 volts, as indicated. The minus input of the comparator 287 is connected to the "CS1" line 56. In operation, if the input current to the pre-conditioner circuit 28 should exceed a certain level, the over-current comparator 287 applies a signal to the OR gate 286 to the line 217 and through the OR gate 216 to reset the pre-conditioner flip-flop 194 (see FIG. 6).

A second input of the OR gate 286 is connected to an output of a "PWM OFF" flip-flop 288 which has a set input connected to the output of a Schmitt trigger circuit 289 having one input connected to the "VSUPPLY" line 39 and having a second input connected to the voltage regulator line 42. As shown, a voltage regulator 290 is incorporated in the control circuit 36 and is supplied with the voltage on line 39 to develop the regulated voltage on line 42. The output of the Schmitt trigger circuit 289 is also applied to the set input of a flip-flop 292 which is connected to the "HBOFF" line 222. In operation, if the supply voltage should drop below a certain level, both flip-flops 288 and 292 are set to disable the pulse width modulator and half bridge oscillator circuits.

The reset input of the flip-flop 292 is connected to the output of a "DMAX" comparator 294 which has a plus input connected to the "DMAX" line 53, the minus input of the comparator 294 being connected to a source of a reference voltage which may be 1/7 ("VREG") as indicated. The reset input of the flip-flop 288 is connected to the output of an inverter 295 which has an input connected to the output of the comparator 294. The "DMAX" line 53 is also connected through a switch 296 to ground, switch 296 being controlled by the "PWM OFF" flip-flop 288.

It is noted that the output of the flip-flop 288 is also connected through a line 297 to a third input of the OR gate 266 in the frequency control circuitry shown in FIG. 7. An overvoltage comparator 300 has an input connected to the "OV" line 50 and an output connected through the OR gate 256 to the "PWM OFF" line 217.

In the operation of the pulse width modulator control circuitry of FIG. 8, the flip-flops 288 and 292 are, of course, in a reset condition when the controller is initially energized. After a certain time delay, as required for the voltage on the "VSUPPLY" and "VREG" lines 39 and 42 to develop, the Schmitt trigger circuit operates to set both flip-flops 288 and 292 but thereafter, the flip-flop 288 is reset through the inverter 295 from the output of the "DMAX" comparator 294. Then, when the "DMAX" capacitor 52 is charged to a value greater than 1/7 (VREG), the "DMAX" comparator operates to reset the "HBOFF" flip-flop 292. At this time, operation of the "HB" oscillator flip-flop 196 (FIG. 6) may commence. The operation of the "PC" flip-flop 194 (FIG. 6) may also commence. Initially the width of the "GPC" gate pulses are controlled by the increasing signal on the "DMAX" line 53 so that the output of the pre-conditioner circuit 28 gradually increases and thus, a "soft" start is obtained.

The "DMAX" voltage thus controls a time delay in turning on the oscillator circuitry after initial energization and thereafter controls the width of pulses generated by the pulse width modulator flip-flop 194, so as to obtain the gradually increasing voltage and the "soft" start.

The illustrated construction of the dimming interface circuit is particularly advantageous in that it is readily connected to and usable with the controller 10 as disclosed which provides dynamic controls to automatically respond to variations in operating conditions and in the values or characteristics of components in a manner such as to obtain safe and reliable operation while at the same time achieving optimum performance and efficiency. For example, the dimmer circuit is operative over a wide range of frequencies such as developed during operation the controller 10 which is so operated as to allow for substantial variations in the resonant frequency in the output circuit. The clipping circuit provides tight control of the voltage across the secondary winding and with the tight magnetic coupling of the primary and secondary windings and the direct detection of the voltage across the primary winding, the relationship of the dimmer circuit output to its input is substantially independent of frequency over a wide range.

Figure 10:
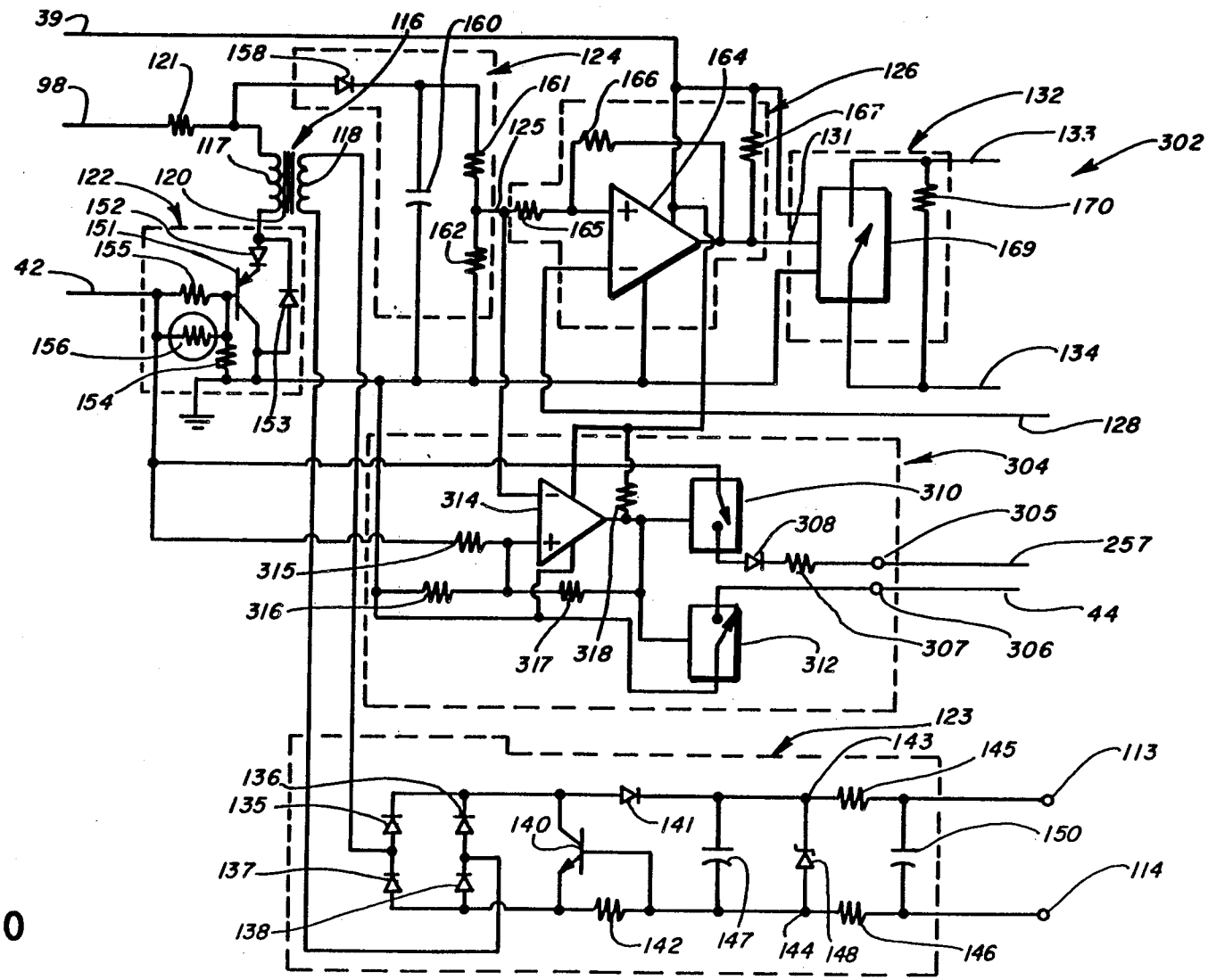
FIG. 10 shows a modified form of dimming interface circuit constructed in accordance with the invention and also shows its connections to the fluorescent lamp controller of FIGS. 1–3 and 6–8.

Modified Circuit With OnOff Control (FIG. 10)

FIG. 10 shows a modified dimming interface circuit 302 which is constructed in accordance with the principles of the invention and which is operative to provide an "OFF" function. The circuit 302 includes the transformer 116, level shift circuit 122, clipping circuit 123, peak detector and scaling circuit 124, comparator circuit 126 and analog switch circuit 132 of the circuit shown in FIG. 4. In addition, it includes an on/off circuit 304 having output terminal 305 and 306 which are connected to the "FMIN" line 257 and the "START" line 44. The output terminal 305 is connected through a resistor 307, a diode 308 and an analog switch 310 to the "VREG" line 42. The output terminal 306 is connected through a second analog switch 312 to ground.

Analog switches 310 and 312 are controlled from an output of comparator 314 which has a minus input connected to the output line 125 of the peak detector and scaling circuit 124. The plus input of comparator 314 is connected through a resistor 315 to the "VREG" line 42, through a resistor 316 to ground and through a resistor 317 to the output of the comparator 314 which is also connected through a resistor 318 to the "VSUPPLY" line 39.

In operation, the output of the peak detector and scaling circuit 14 is sensed at the minus input of the comparator 314 and when it equals a reference voltage applied to the plus input, the output of comparator 314 switches from a "low" state to a "high" state, to simultaneously switch the two analog switches 310 and 312 to an "on" or closed condition. The switch 312 operates to discharge the capacitor 45 which is connected to the "START" line 44 while the analog switch 310 injects a calibrated DC current into the "FMIN" input of the control circuit 36. The calibrated DC current is determined by the value of resistor 307 and causes the controller circuit to operate at a frequency which is well above the preheat frequency. In this high frequency state, the frequency of operation is very far away from resonance and no significant power is delivered to the lamp load, including the filaments. The lamps are then extinguished and a low power "OFF" condition results, but the lamps can be quickly reenergized by increasing the control voltage applied to the input terminals. Hysteresis from positive feedback resistor 317 insures clean transitions.

It will be understood that modifications and variations may be effected without departing from the spirit and scope of the novel concepts of this invention.

We claim:

1. A dimmer circuit for operating in response to a control voltage from a control voltage source to control a high frequency AC lamp-energizing source of a lamp controller and to thereby control light intensity, said dimmer circuit comprising: an isolation transformer including coupled primary and secondary winding means, means for applying a high frequency current from said controller to said primary winding means, input terminals for connection to said control voltage source, loading means coupled to said secondary winding means and to said input terminals and arranged to limit the voltage across said secondary winding means as a function of said control voltage and to thereby limit the high frequency voltage developed across said primary winding means from said high frequency current, and detector and output means for developing and applying to said controller an output signal for control of lamp intensity which corresponds to the high frequency voltage developed across said primary winding means, said loading means including amplifier means and being arranged to respond to a small control current through said voltage source to produce amplified and substantially equal loading currents in said secondary winding means in both half cycles of said high frequency current applied to said primary winding means.

2. A dimmer circuit as defined in claim 1, wherein said small control current flows in a direction to transfer power from said loading means to said voltage source.

3. A dimmer circuit as defined in claim 1, wherein said amplifier means are arranged to conduct current in one direction only and said loading circuit comprises a full-wave rectifier having first and second output terminals coupled to said amplifier means and having an input coupled to said secondary winding means.

4. A dimmer circuit as defined in claim 3, wherein said full-wave rectifier includes four diodes in a bridge configuration.

5. A dimmer circuit as defined in claim 3, wherein said secondary winding means comprises a secondary winding having a center tap connected to said first output terminal and wherein said full-wave rectifier includes two diodes connected between opposite ends of said secondary winding and said second output terminal.

6. A dimmer circuit as defined in claim 3, wherein said amplifier means comprises a transistor having base, emitter and collector electrodes, means coupling said emitter and collector electrodes to said full-wave rectifier means, resistance means connecting said base and emitter electrodes, and means coupling said collector and base electrodes to said input terminals.

7. A dimmer circuit as defined in claim 6, wherein said small control current flows in a path extending from said second output terminal of said full-wave rectifier to one of said input terminals, thence through said voltage source to the other of said input terminals, and thence from said other of said input terminals and through said resistance means to said first output terminal of said full-wave rectifier.

8. A dimmer circuit as defined in claim 1, wherein said loading means includes filter means operative to minimize transmission of noise signals to said control voltage source.

9. A dimmer circuit as defined in claim 8, wherein said filter means comprises resistance means in series between said input terminals and said amplifier means, and capacitor means in shunt relation to said input terminals and said input of said amplifier means.

10. A dimmer circuit for operating in response to a control voltage from a control voltage source to control a high frequency AC lamp-energizing source of a lamp controller and to thereby control light intensity, said dimmer circuit comprising: an isolation transformer including coupled primary and secondary winding means, means for applying a high frequency current from said controller to said primary winding means, input terminals for connection to said control voltage source, loading means coupled to said secondary winding means and to said input terminals and arranged to limit the voltage across said secondary winding means as a function of said control voltage and to thereby limit the high frequency voltage developed across said primary winding means from said high frequency current, and detector and output means for developing and applying to said controller an output signal for control of lamp intensity which corresponds to the high frequency voltage developed across said primary winding means, said detector and output means including peak detector means connected directly to said primary winding means and arranged to develop a DC signal component which is directly proportional to a peak voltage developed across said primary winding in each half cycle of one polarity of said high frequency current.

11. A dimmer circuit as defined in claim 10, further including level shift means for adding a bias component to said DC signal component.

12. A dimmer circuit as defined in claim 11, wherein said level shift means comprises transistor means in series with said primary winding means, and level control means for controlling current conducted by said transistor means to control the voltage thereacross, and wherein said peak detector means responds to the total of the voltage across said primary winding means and said transistor means during each half cycle of said one polarity of said high frequency voltage.

13. A dimmer circuit as defined in claim 12, wherein said level control means comprises temperature correction network which includes a thermistor and which controls conduction through said transistor as a function of ambient temperature.

14. A dimmer circuit as defined in claim 12, wherein said level control means includes reverse-poled diode means in parallel with said transistor for conducting current during each half cycle of said high frequency voltage of a polarity opposite said one polarity.

15. A dimmer circuit for operating in response to a control voltage from a control voltage source to control a high frequency AC lamp-energizing source of a lamp controller and to thereby control light intensity, said dimmer circuit comprising: an isolation transformer including coupled primary and secondary winding means, means for applying a high frequency current from said controller to said primary winding means, input terminals for connection to said control voltage source, loading means coupled to said secondary winding means and to said input terminals and arranged to limit the voltage across said secondary winding means as a function of said control voltage and to thereby limit the high frequency voltage developed across said primary winding means from said high frequency current, and detector and output means having a pair of output terminals for connection to said controller to control lamp intensity as a function of the high frequency voltage developed across said primary winding means, said detector and output means comprising peak detector means connected arranged to develop a DC signal which includes a component corresponding to a peak voltage developed across said primary winding, and output means responsive to said D signal to control the effective resistance between said pair of output terminals.

16. A dimmer circuit as defined in claim 15, wherein said output means comprises a comparator having first and second input terminals, means for applying said DC signal to said said first input terminal, means for applying a periodic triangular wave signal to said second input terminal, and analog switch means coupled to said pair of output terminals and controlled by said comparator.

17. A dimmer circuit as defined in claim 1 wherein said primary and secondary winding means are tightly coupled.

18. A dimmer circuit for operating in response to a control voltage from a control voltage source to control a high frequency AC lamp-energizing source of a lamp controller and to thereby control light intensity, said dimmer circuit comprising: an isolation transformer including coupled primary and secondary winding means, means for applying a high frequency current from said controller to said primary winding means, input terminals for connection to said control voltage source, loading means coupled to said secondary winding means and to said input terminals and arranged to limit the voltage across said secondary winding means as a function of said control voltage and to thereby limit the high frequency voltage developed across said primary winding means from said high frequency current, detector and output means for developing and applying to said controller an output signal for control of lamp intensity which corresponds to the high frequency voltage developed across said primary winding means, and on-off control means for controlling on-off operation of said lamp controller as a function of a threshold value of said control voltage.

19. A dimmer circuit as defined in claim 18, wherein said detector means includes means for developing a DC signal as a function of a peak voltage developed across said primary winding means, and wherein said on-off control means include comparison means for comparing said DC signal with a reference voltage.

20. A dimmer circuit as defined in claim 19, wherin said comparison means includes positive feedback means to provide hysterisis.

* * * * *